US008209048B2

(12) United States Patent
Zehnpfund et al.

(10) Patent No.: US 8,209,048 B2
(45) Date of Patent: Jun. 26, 2012

(54) METHOD AND APPARATUS FOR CREATING A COMPREHENSIVE RESPONSE MODEL FOR A SHEET FORMING MACHINE

(75) Inventors: Andreas Zehnpfund, Frankfurt am Main (DE); Shih-Chin Chen, Dublin, OH (US); Jonas Berggren, Solna (SE)

(73) Assignees: ABB Automation GmbH, Mannheim (DE); ABB Ltd., Dublin (IE)

( * ) Notice: Subject to any disclaimer, the term of this patent is extended or adjusted under 35 U.S.C. 154(b) by 637 days.

(21) Appl. No.: 12/352,328

(22) Filed: Jan. 12, 2009

(65) Prior Publication Data

US 2010/0179791 A1 Jul. 15, 2010

(51) Int. Cl.
*G06F 19/00* (2006.01)

(52) U.S. Cl. ..... 700/129; 700/45

(58) Field of Classification Search ..... 700/122, 700/29, 30, 45, 128, 129; 703/2, 12; 702/189; 162/263

See application file for complete search history.

(56) References Cited

U.S. PATENT DOCUMENTS

| | | | |
|---|---|---|---|
| 4,374,703 | A | 2/1983 | Lebeau et al. |
| 4,965,736 | A | 10/1990 | Balakrishnan |
| 4,982,334 | A | 1/1991 | Balakrishnan |
| 5,191,521 | A | 3/1993 | Brosilow |
| 5,400,258 | A | 3/1995 | He |
| 5,541,833 | A | 7/1996 | Bristol et al. |
| 5,574,638 | A | 11/1996 | Lu |
| 5,893,055 | A | 4/1999 | Chen |
| 6,086,237 | A | 7/2000 | Gorinevski et al. |
| 6,233,495 | B1 | 5/2001 | Chen |
| 6,577,323 | B1 | 6/2003 | Jamieson et al. |
| 6,587,108 | B1 | 7/2003 | Guerlain et al. |
| 6,587,744 | B1 | 7/2003 | Stoddard et al. |
| 6,650,947 | B2 | 11/2003 | Fu et al. |
| 6,760,631 | B1 | 7/2004 | Berkowitz et al. |
| 6,826,521 | B1 | 11/2004 | Hess et al. |
| 6,882,889 | B2 | 4/2005 | Fuller et al. |

(Continued)

FOREIGN PATENT DOCUMENTS

| | | |
|---|---|---|
| EP | 10152571 | 1/2007 |

(Continued)

OTHER PUBLICATIONS

Chen, Shih-Chin and Subbarayan, Ravi. Cross-machine Direction (CD) Response Modeling with Two-dimensional Sheet Variation Measurements. In Proceedings of the American Control Conference, Jun. 1999, pp. 3082-3086.*

(Continued)

*Primary Examiner* — Dave Robertson
(74) *Attorney, Agent, or Firm* — Paul R. Katterle

(57) ABSTRACT

A method and apparatus for generating a comprehensive response model for a sheet forming machine are provided. A finite number of critical points and a response type are used to create a continuous response profile for each actuator zone. The continuous response profile for each actuator zone is discretized into a discrete response profile based on the resolution appropriate for an application. A multi-zone response model for each pair of actuator set and sheet property profile is created from the discretized response profile of the actuator zones in the actuator set. The comprehensive response model for a multivariable sheet-forming machine is created from a collection of multi-zone response models for multiple pairs of actuator sets and sheet property profiles.

22 Claims, 11 Drawing Sheets

U.S. PATENT DOCUMENTS

| | | | | |
|---|---|---|---|---|
| 6,901,560 | B1 | 5/2005 | Guerlain et al. | |
| 7,142,626 | B2 | 11/2006 | Cheng | |
| 7,187,989 | B2 | 3/2007 | Attarwala | |
| 7,191,106 | B2 | 3/2007 | Minor et al. | |
| 7,454,253 | B2 * | 11/2008 | Fan | 700/29 |
| 7,820,012 | B2 | 10/2010 | Stewart | |
| 2005/0137721 | A1 | 6/2005 | Attarwala | |
| 2005/0149209 | A1 | 7/2005 | Wojsznis et al. | |
| 2007/0260335 | A1 | 11/2007 | Fan et al. | |
| 2009/0128799 | A1 | 5/2009 | MacHattie | |
| 2010/0174512 | A1 | 7/2010 | Berggren | |
| 2010/0179791 | A1 | 7/2010 | Zehnfund | |
| 2010/0198364 | A1 | 8/2010 | Chen | |

FOREIGN PATENT DOCUMENTS

| | | | |
|---|---|---|---|
| GB | 2432682 | A | 5/2007 |
| WO | 2007050692 | A2 | 5/2007 |
| WO | 2010080869 | A1 | 7/2010 |
| WO | 2010081065 | A2 | 7/2010 |

OTHER PUBLICATIONS

Chen, Shih-Chin; Berggren, Jonas; Zehnpfund, Andreas. Multivariable CD control applications. In IPW, Focus on Process and Quality Control, Oct. 2008, 4 pages.*

Chen et al., Optimal Control of Cross-Machine Direction Web Profile with Constraints on the Control Effort, American Control Conference, 1986, pp. 1409-1415.

Rigopoulos et al.,Model Predictive Control of CD Profiles in Sheet Forming Processes Using Full Profile Disturbance Models Identified by Adaptive PCA, Proceedings of the 1997 American Control Conference, 1997, pp. 1468-1472.

Ghofraniha et al., Modelling of Sheet Formation including Edge Effects on Paper Machines, IEEE International Conference on Systems, Man and Cybernetics, 1995, pp. 3363-3367.

Kayihan, F., Practical Estimation of CD Control Performance, Proceedings of the 1999 American Control Conference, 1999, p. 1.

Mustonen,H., Coordinated Profile Control of Base Sheet and Coated Products, Second IEEE Conference on Control Applications, 1993, pp. 365-370.

Mustonen,H., Coordinated Profile Control of Base Sheet and Coated Products Properties, Second IEEE Conference on Control Applications, 1993, pp. 365-370.

Tran,P, et al., Coordinating Control of Multiple Cross-direction Actuators in Sheet Forming Processes, International CD Symposium 1997 Tampere, Finland, Jun. 4-5, 1997, pp. 113-119.

Rao,C., et al., Efficient Implementation of Model Predictive Control for Sheet and Film Forming Processes, Proc. of American Control Conference, Albuquerque, NM, Jun. 1997, pp. 2940-2944.

Backstrom, J., et al., Constrained Model Predictive Control for Cross Directional Multi-Array Processes, Control Systems 2000, Victoria, BC, May 1-4, 2000. pp. 331-336.

Backstrom, J., et al., Identification and Multivariable Control of Supercalenders, Control Systems 2002, Stockholm, Sweden, Jun. 3-5, 2002. pp. 85-91.

* cited by examiner

| | | Actuator Set 1 | | | | | | | Actuator Set 2 | | | | | |
|---|---|---|---|---|---|---|---|---|---|---|---|---|---|---|
| | zone number | 1 | 2 | 3 | 4 | 5 | ... | N1 | 1 | 2 | 3 | 4 | 5 | ... |
| Property Profile 1 | response type | 1 | 1 | 1 | 1 | 1 | ... | 1 | 1 | 1 | 1 | 1 | 1 | ... |
| | CD CP0 | (5.5, 0.9) | (15, 0.89) | (25.4, 0.91) | (35.1, 0.88) | (45.5, 0.9) | ... | (594, 0.88) | (5.5, 0.9) | (15, 0.89) | (25.4, 0.91) | (35.1, 0.88) | (45.5, 0.9) | ... |
| | CD CP1 | (40.4, 0) | (41, 0) | (39.5, 0) | (40.1, 0) | (40, 0) | ... | (39.6, 0) | (40.4, 0) | (41, 0) | (39.5, 0) | (40.1, 0) | (40, 0) | ... |
| | CD CP2 | (40, 0) | (40.5, 0) | (39.8, 0) | (40., 0) | (40.2, 0) | ... | (39.5,0) | (40, 0) | (40.5, 0) | (39.8, 0) | (40., 0) | (40.2, 0) | ... |
| | CD CP3 | ... | ... | ... | ... | ... | ... | ... | ... | ... | ... | ... | ... | ... |
| | CD CP4 | ... | ... | ... | ... | ... | ... | ... | ... | ... | ... | ... | ... | ... |
| | CD CP5 | ... | ... | ... | ... | ... | ... | ... | ... | ... | ... | ... | ... | ... |
| | CD CP6 | ... | ... | ... | ... | ... | ... | ... | ... | ... | ... | ... | ... | ... |
| | | | | | | | | | | | | | | |
| | | | | | | | | | | | | | | |
| Property Profile 2 | response type | 3 | 3 | 3 | 3 | 3 | ... | 3 | 3 | 3 | 3 | 3 | 3 | ... |
| | CD CP0 | (5.5, 0.9) | (15, 0.89) | (25.4, 0.91) | (35.1, 0.88) | (45.5, 0.9) | ... | (594, 0.88) | (5.5, 0.9) | (15, 0.89) | (25.4, 0.91) | (35.1, 0.88) | (45.5, 0.9) | ... |
| | CD CP1 | (40.4, 0) | (41, 0) | (39.5, 0) | (40.1, 0) | (40, 0) | ... | (39.6, 0) | (40.4, 0) | (41, 0) | (39.5, 0) | (40.1, 0) | (40, 0) | ... |
| | CD CP2 | (40, 0) | (40.5, 0) | (39.8, 0) | (40., 0) | (40.2, 0) | ... | (39.5,0) | (40, 0) | (40.5, 0) | (39.8, 0) | (40., 0) | (40.2, 0) | ... |
| | CD CP3 | (23, -0.3) | (22.6, -0.31) | (22.8, -0.28) | (23.2, -0.31) | (23, -0.3) | ... | (23, -0.29) | (23, -0.3) | (22.6, -0.31) | (22.8, -0.28) | (23.2, -0.31) | (23, -0.3) | ... |
| | CD CP4 | (23.1, -0.3) | (23.2, -0.3) | (22.9, -0.27) | (23, -0.33) | (22.5, -0.25) | ... | (23.3, -0.31) | (23.1, -0.3) | (23.2, -0.3) | (22.9, -0.27) | (23, -0.33) | (22.5, -0.25) | ... |
| | CD CP5 | ... | ... | ... | ... | ... | ... | ... | ... | ... | ... | ... | ... | ... |
| | CD CP6 | ... | ... | ... | ... | ... | ... | ... | ... | ... | ... | ... | ... | ... |
| | | | | | | | | | | | | | | |
| | | | | | | | | | | | | | | |

210

Fig. 9

| | | Actuator Set 1 | | | | | | |
|---|---|---|---|---|---|---|---|---|
| | zone number | 1 | 2 | 3 | 4 | 5 | . . . | N1 |
| Property Profile 1 | response type | 1 | 1 | 1 | 1 | 1 | . . . | 1 |
| | CD CP0 | (5.5, 0.9) | (15, 0.89) | (25.4, 0.91) | (35.1, 0.88) | (45.5, 0.9) | . . . | (594, 0.88) |
| | CD CP1 | (40.4, 0) | (41, 0) | (39.5, 0) | (40.1, 0) | (40, 0) | . . . | (39.6, 0) |
| | CD CP2 | (40, 0) | (40.5, 0) | (39.8, 0) | (40., 0) | (40.2, 0) | . . . | (39.5,0) |
| | CD CP3 | . . . | . . . | . . . | . . . | . . . | . . . | . . . |
| | CD CP4 | . . . | . . . | . . . | . . . | . . . | . . . | . . . |
| | CD CP5 | . . . | . . . | . . . | . . . | . . . | . . . | . . . |
| | CD CP6 | . . . | . . . | . . . | . . . | . . . | . . . | . . . |
| | MD CP1 | (20, 0) | (21, 0) | (19, 0) | (20.4, 0) | (22.4, 0.0) | . . . | (23.4, 0) |
| | MD CP2 | (120, 1.0) | (121, 1.1) | (120.5,0.94) | (122.1, 1.0) | (123.1, 0.99) | | (123.3, 1.01) |

212

Fig. 10

METHOD AND APPARATUS FOR CREATING A COMPREHENSIVE RESPONSE MODEL FOR A SHEET FORMING MACHINE

CROSS-REFERENCE TO RELATED APPLICATION

This application is related to U.S. patent application Ser. No. 12/350,489, entitled "A Method and Apparatus for Creating a Generalized Response Model for a Sheet Forming Machine", filed on Jan. 8, 2009, which is hereby incorporated by reference in its entirety.

BACKGROUND OF THE INVENTION

The present invention relates in general to controlling sheet forming processes and, more particularly, to improving the control of such processes.

In a sheet forming machine, the properties of a sheet vary in the two directions of the sheet, namely the machine direction (MD) which is the direction of sheet movement during production and the cross machine direction (CD), which is perpendicular to the MD and is the direction across the width of the sheet during production. Different sets of actuators are used to control the variations in each direction. The machine direction (MD) is associated with the direction of sheet moving speed, hence MD is also considered as temporal direction (TD). Similarly, the cross machine direction is associated with the width of the sheet, hence CD is also considered as spatial direction (SD).

The MD variations are generally affected by factors that impact the entire width of the sheet, such as machine speed, the source of base materials like wood fiber being formed into a sheet by the machine, common supplies of working fluids like steam, water and similar factors.

The CD variations are normally influenced by arrays of actuators located side-by-side across the width of the machine. Each actuator represents a zone of the overall actuator set. In a paper machine, the typical CD actuators are slice screws of a headbox, headbox dilution valves, steam boxes, water spraying nozzles, induction actuators, and other known devices. CD actuators present a great challenge for papermakers since a sheet-forming machine may have multiple sets of CD actuators, each with multiple numbers of zones spread across the entire width of a machine. Each set of CD actuators is installed at a different location of a sheet-making machine. There are different numbers of individual zones in each set of CD actuators. The width of each zone might also be different within the same set. Therefore, each set of CD actuators could have very different impacts on different sheet properties.

Measurements of sheet properties may be obtained from fixed sensors or from scanning sensors that traverse back and forth across the width of a sheet. The sensors are usually located downstream from those actuators that are used to adjust the sheet properties. The sensors measure the sheet properties while traveling across the sheet and use the measurement to develop a property profile across the sheet. The sheet property profile is typically discretized in a finite number of points across the sheet called "databoxes". Presently, a sheet property profile is usually expressed in several hundreds to more than a thousand databoxes. The sheet property profiles accumulated in time form a two-dimensional matrix. The sheet property measurement at a fixed databox over a period of time can also be viewed like a profile in "temporal" direction or MD. The term "profile" is used with respect to either CD or MD. The sheet property profile is used by a quality control system (QCS) to derive control actions for the appropriate actuators so that the sheet property profile is changed toward a desired target profile. The target shape can be uniformly flat, smile, frown, or other gentle shapes. In order to control sheet property profiles with multiple set of CD actuators, it is important to measure and identify how each CD actuator influences the profiles.

Since the sensors are often located a considerable distance downstream from the CD actuators, the portion of the sheet (in the CD direction) influenced by a CD actuator zone but measured by the downstream sensors is not always perfectly aligned (in the CD direction) with the CD actuator zone, due to sheet shrinkage in the drying process or the sheet wandering sideways while the sheet is traveling through the machine. Furthermore, each CD actuator zone typically affects a portion of the profile that is wider than the portion corresponding to the width of the CD actuator zone. Thus, for controlling the CD profile of a sheet-forming machine, it is important to know which portion of the profile is affected by each CD actuator zone. The functional relationship that describes which portion of the profile is affected by each CD actuator zone is called "mapping" of the CD actuator zones.

In addition to knowing which portion of the profile is affected by which CD actuator zone, it is also important to know how each CD actuator zone affects the profile. The functional curve that illustrates how the sheet property profile is changed by the adjustment of a CD actuator zone is called the "response model" of the CD actuator zone. Conventionally, the response model for a CD actuator zone is represented with an array of discrete values or is modeled with wave propagation equations if the response is related to the spread of the slurry on the Fourdrinier wire. For a typical set of CD actuators, there are easily tens to a few hundreds of zones. For each actuator zone, if the response model is represented by an array of uniform discrete points, the model will be specified in either actuator resolution, which is the number actuator zones, or property profile resolution, which could have hundreds to more than a thousand points. Many paper machines today are equipped with multiple sets of CD actuators. The number of points needed to represent the response model for one sheet property profile for all actuator zones is the number of points per actuator zone multiplied by the total number of zones of multiple sets of CD actuators. In practice each set of actuators can change several sheet property profiles at the same time, and each sheet property profile may also be affected by multiple sets of CD actuators with different responses. These different responses are classified as different response types. The number of points needed to represent a comprehensive response model is further multiplied by the number of sheet property profiles. A comprehensive response model that relates the multiple sets of CD actuators and the multiple high-resolution sheet property profiles specified by the conventional approach will need a massive number of points. This is very inefficient, rigid, and subjects to errors in practice.

For specifying response models for a multivariable sheet-making process, the conventional approaches become extremely cumbersome and impractical. An effective and generalized framework for specifying the response model of all CD actuators is needed to implement a better CD control for a sheet-making machine. Therefore, it would be desirable, if a response model could be effectively described using one or a few critical points and continuous functions. The present invention is directed to such a method and apparatus for creating a generalized response model using one or a few critical points and continuous functions in an effective and user-friendly manner.

SUMMARY OF THE INVENTION

In accordance with the present invention, a method is provided for creating a response model for at least one actuator zone operable to control properties of a sheet. In accordance with the method, a continuous response model for the at least one actuator zone is provided. The continuous response model includes a plurality of continuous functions. The continuous functions of the continuous response model are discretized to obtain an array of points. A comprehensive response model is created using the points from the discretized continuous functions. A control system operable to perform the foregoing method is also provided.

BRIEF DESCRIPTION OF THE DRAWINGS

The features, aspects, and advantages of the present invention will become better understood with regard to the following description, appended claims, and accompanying drawings where:

FIG. 9 shows a table of critical points of two sets of actuators with respect to two sheet profiles;

FIG. 10 shows a table of critical points that includes MD critical points.

DETAILED DESCRIPTION OF ILLUSTRATIVE EMBODIMENTS

Figure 1:
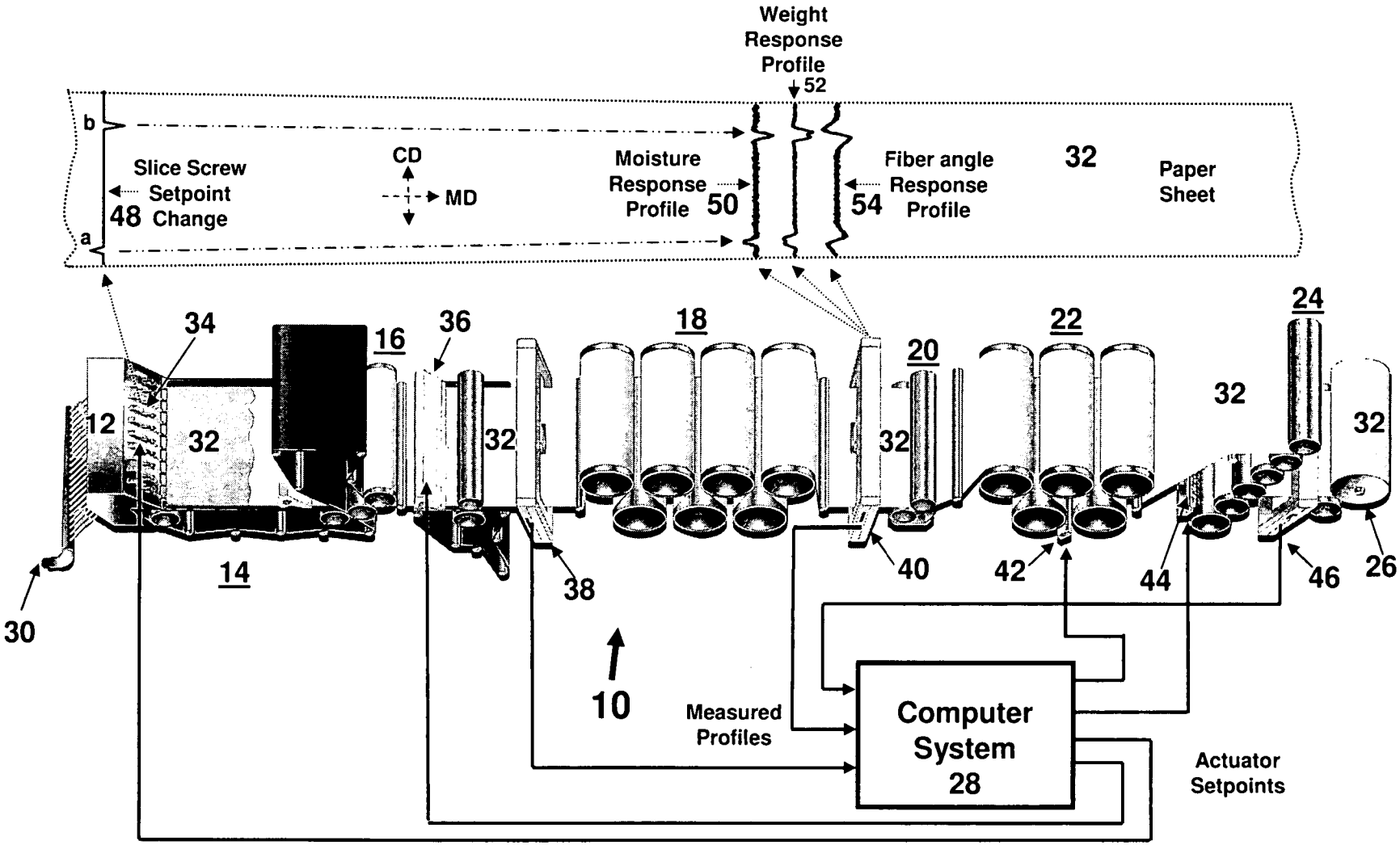
FIG. 1 shows a schematic view of a paper machine and the relationship between a CD actuator bump test and its impacts on sheet property profiles.

While the present invention is generally applicable to machines for processing wood fiber, metal, plastics, and other materials in the form of a sheet, it is particularly applicable to paper making machines and accordingly will be described herein with reference to such a machine. Referring now to FIG. 1, there is shown a paper making machine 10 that generally includes a stock approaching system 30, a headbox 12, a wire section 14, a press section 16, first and second dryer sections 18, 22, a sizing section 20, a calendar stack 24 and a roll-up spool 26. The paper making machine 10 makes a paper sheet by receiving furnished materials (including wood fibers and chemicals) that are diluted in water (the mixture being called "stock") through an in-flow 30, passing the stock through the headbox 12, dispersing the stock on the wire section 14, draining water to form a wet sheet 32, squeezing more water out at the press section 16, evaporating the remaining water at the dryer sections 18 and 22, treating the surface of the sheet 32 at the sizing section 20 and the calender stack 24 before rolling the sheet 32 on to the roll-up spool 26. The calender stack 24 also alters sheet thickness.

A computer system 28 is provided for use with the paper making machine 10. The computer system 28 includes a QCS for monitoring and controlling the paper making machine 10. The QCS comprises one or more controllers and one or more computers. The computer system 28 may further include one or more other computers for performing off-line tasks related to the paper making machine 10 and/or the QCS. At least one of the computers of the computer system 28 has user interface devices (UI) that includes one or more display devices, such as a monitor (with or without a touch screen) or a hand-held devices such as a cell phone for displaying graphics, and one or more entry devices, such as a keyboard, a mouse, a track ball, a joystick, a hand-held and/or voice-activated devices.

At the output side of the headbox 12 there is a narrow opening, also known as "slice opening", that disperses the furnished flow on the wire to form the paper sheet 32. The slice opening is adjusted by an array of slice screws 34 extending across the sheet width. The position settings of the slice screws 34 change the opening gap of the headbox 12 and influence the distribution and the uniformity of sheet weight, moisture content, fiber orientation, and sheet thickness in the CD direction. The slice screws 34 are often controlled by CD actuators attached to the slice screws 34. The position of each slice screw 34 is controlled by setting a target position, also known as a "setpoint" for the corresponding CD actuator zone. Near the end of the wire section 14 or in the press section 16, one or multiple arrays of steam nozzles 36 that extend across the sheet web are often installed in order to heat the water content in the sheet 32 and allow the moisture content of the sheet 32 to be adjusted. The amount of steam that goes through the nozzles 36 is regulated by the target or setpoint selected for each nozzle 36. Further downstream in dryer sections 18 or 22, one or multiple arrays of water spray nozzles 42 that extend across the web are often installed in order to spray misty water drops on the sheet 32 to achieve uniform moisture profile. The amount of water sprayed on the paper sheet is regulated by the target or setpoint selected for each spray nozzle 42. Near the end of paper machine 10, one or multiple sets of induction heating zones 44 that extend across the web can also be installed in order to alter sheet glossiness and sheet thickness. The amount of heat applied by the different induction heating zones 44 is regulated by the target or setpoint selected for each induction heating zone 44. The influence of multiple sets of CD actuators (including those described above) can be seen on multiple sheet properties that are measured by sensors in one or multiple frames 38, 40, and/or 46. Usually, each frame has one or multiple sensors, each of which measures a different sheet property. For example, the frame 40 in FIG. 1 may have weight, moisture, and fiber orientation sensors which measure weight, moisture and fiber angle profiles, respectively. It is clear that a papermaking process is a multivariable process having multiple input variables and multiple output variables. In order to effectively control the multiple sheet properties with multiple set of CD actuators, it is important to use a multivariable control system.

Figure 7:
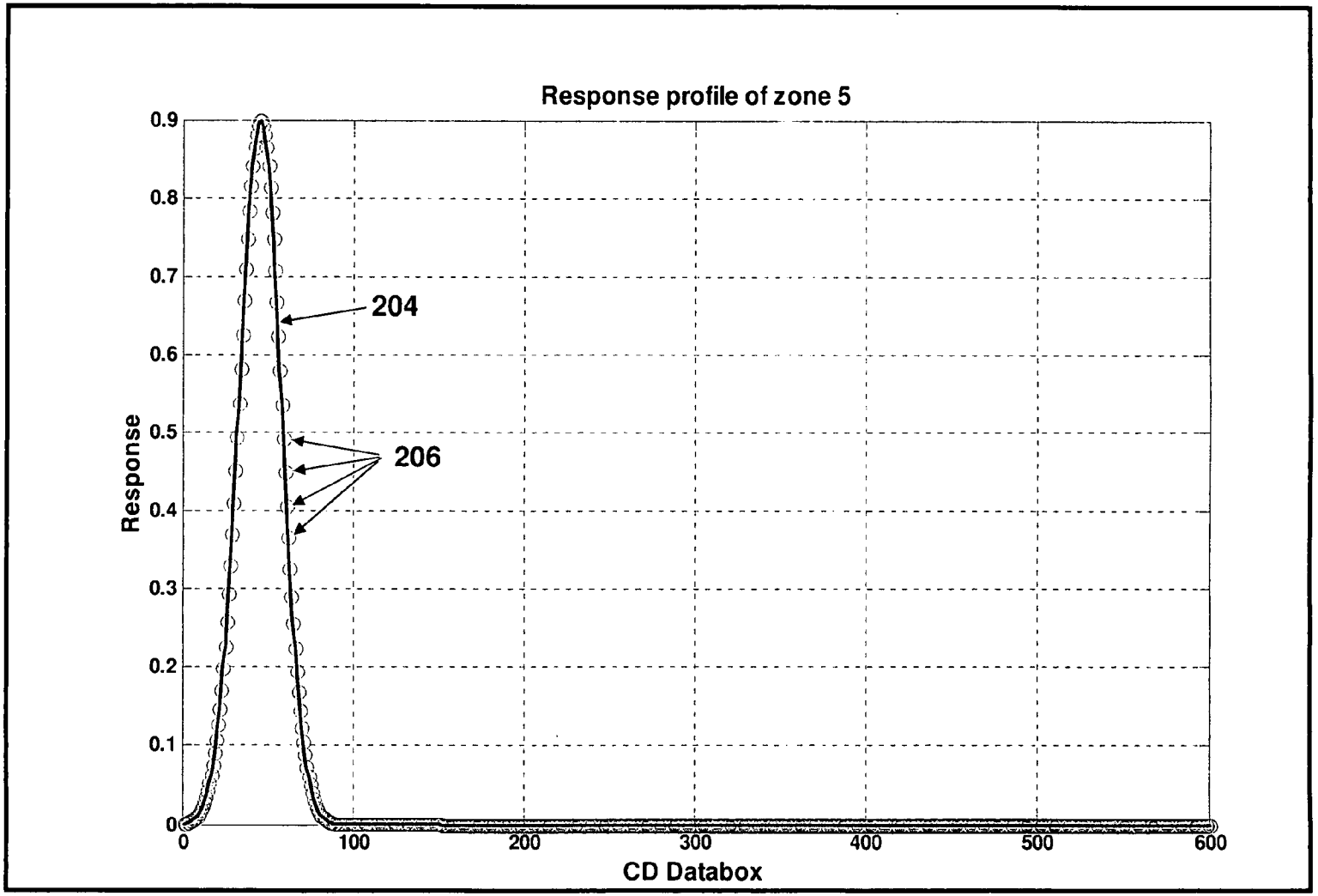
FIG. 7 shows the continuous and discretized response profile of zone 5 actuator.

The change of a sheet property profile as the result of a control action applied to a CD actuator zone is identified from the sheet-forming machines by performing actuator tests. There are various actuator tests that can be performed in order to identify profile responses (for example, see U.S. Pat. No. 6,233,495). For simplicity of explanation, the simple "bump" or "step" test is illustrated here as an example. A "step test" or "bump test" applies a step change to the input, also known as the "setpoint", of a zone in a set of CD actuators while the sheet measuring sensors are measuring the sheet properties. The change of a sheet property profile induced by a unit setpoint change of a CD zone is called a "property response profile", or simply "response profile". Referring to FIG. 1, bump tests are applied to the setpoints of zones "a" and "b" of the set of slice screws 34. The setpoint changes are illustrated by the plot 48 where the changes are applied to zones "a" and "b" but to no other zones. The responses of sheet weight, moisture, fiber angle and other sheet properties resulting from the step setpoint changes applied to zones "a" and "b" are measured by the sensors on the frame 40. As an example, the weight response profile 52, moisture response profile 50, and fiber angle response profile 54 are illustrated in FIG. 1. The shape and the magnitude of each response from each unit change of a zone setpoint can be quite different from the others. The response profile of a zone has certain distinct local maximum, local minimum, inflection, and/or corner points. These points are called "critical points". Critical points can be determined either manually by a person using the UI devices of the computer system 28 or automatically by a critical point analysis program stored in memory and executed by a processor of the computer system 28. Referring to FIG. 7, as an example, in an embodiment where critical points are determined manually by a user, the user clicks on a plotting window to activate a pair of cross hairs (vertical and horizontal lines on the plotting window) and moves the center of the cross hairs to a critical point, the coordinates of the selection point are registered for the selected point. Referring to FIG. 7, as another example, in the current embodiment where critical points are determined manually, the user enters the locations and gains of critical points directly. If the critical point is determined automatically, the computer programs use min, max, and derivative functions to locate the critical points using basic calculus principles. For example, the local maximum and local minimum both have their first derivatives equal to zero. The second derivative of a maximum point is negative and for a minimum point it is positive. For an inflection point, its second derivative is zero. For a corner point, the value of its first derivative is a specific constant or discontinuous.

Using information obtained from an extensive study of various commercially available CD actuators and their effects on a wide range of sheet-making machines, the present invention classifies the response profile of a CD actuator zone into one of five major categories, also called "response types". Each response type is mainly defined by the number of its critical points and the relationship among its critical points. A response profile of a CD actuator zone may be classified into one of the response types either manually by a person using the UI devices of the computer system 28 or automatically by a classification program stored in memory and executed by a processor of the computer system 28.

Figure 2:
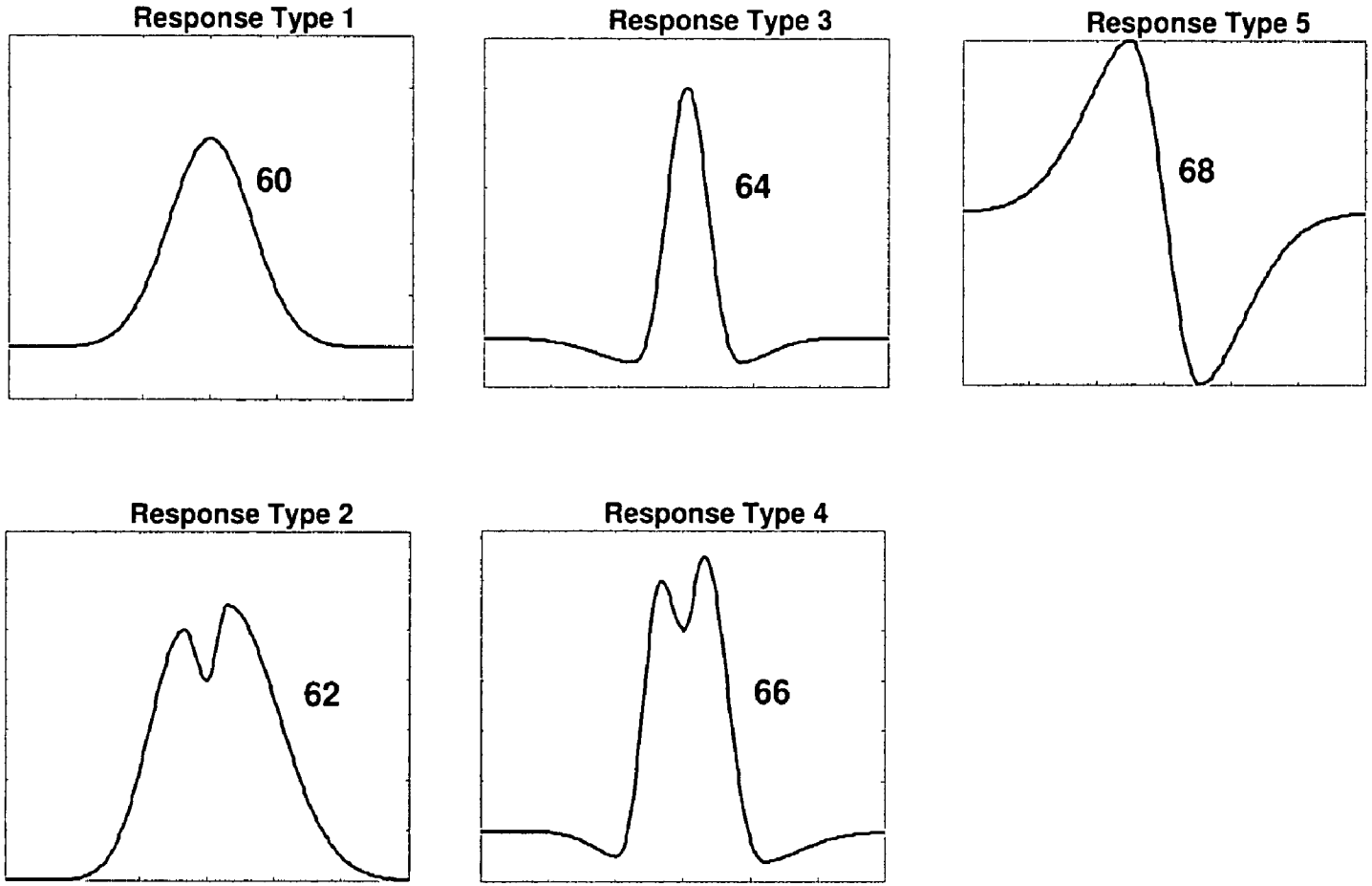
FIG. 2 shows typical response types from CD actuators.

Referring to FIG. 2, an example of five different response types is illustrated. The first response type 60 is commonly obtained from the CD actuators, such as dilution profilers, steam boxes, water sprays and induction profilers. The first response type 60 has only three critical points CP0, CP1, and CP2. The center critical point CP0 is the location of the maximal response magnitude and the other two critical points are the locations of the ends of the response. The second response type 62 is sometimes obtained from an infra-red heating profiler or a steam box. This type of response has five critical points, CP0 to CP2, CP5 and CP6. The two additional critical points CP5 and CP6 adjacent to the center critical point CP0 typically have larger magnitudes than the center critical point CP0 and their signs are the same as that of the center critical point CP0. The third and fourth response types 64, 66 are common to weight responses from slice screw actuators. The third response type 64 also has five critical points. In this response type, the two critical points, CP3 and CP4, adjacent to the center critical point CP0 have the opposite sign of the center critical point CP0. The fourth response type 64 has seven critical points: CP0 to CP6. The first two critical points CP5 and CP6 adjacent to the center critical point CP0 have larger magnitudes than the center critical point CP0 and the sign of their magnitudes is the same as that of the center critical point CP0. The critical points CP3 and CP4 have the opposite sign of the center critical point CP0. The fifth response type 68 is observed as the fiber angle response from slice screw actuators. The fifth response type 68 has either five or seven critical points. For the fifth response type 68, the center critical point CP0 is usually an inflection point with a magnitude at or close to zero. Its immediate adjacent critical points CP5 and CP6 have significant magnitudes but opposite signs. The next pair of critical points CP3 and CP4 have the same sign as their adjacent critical points CP5 and CP6 respectively. Without a generalized model, it is rather difficult to handle these diverse responses effectively for implementing a multivariable control scheme.

Figure 3:
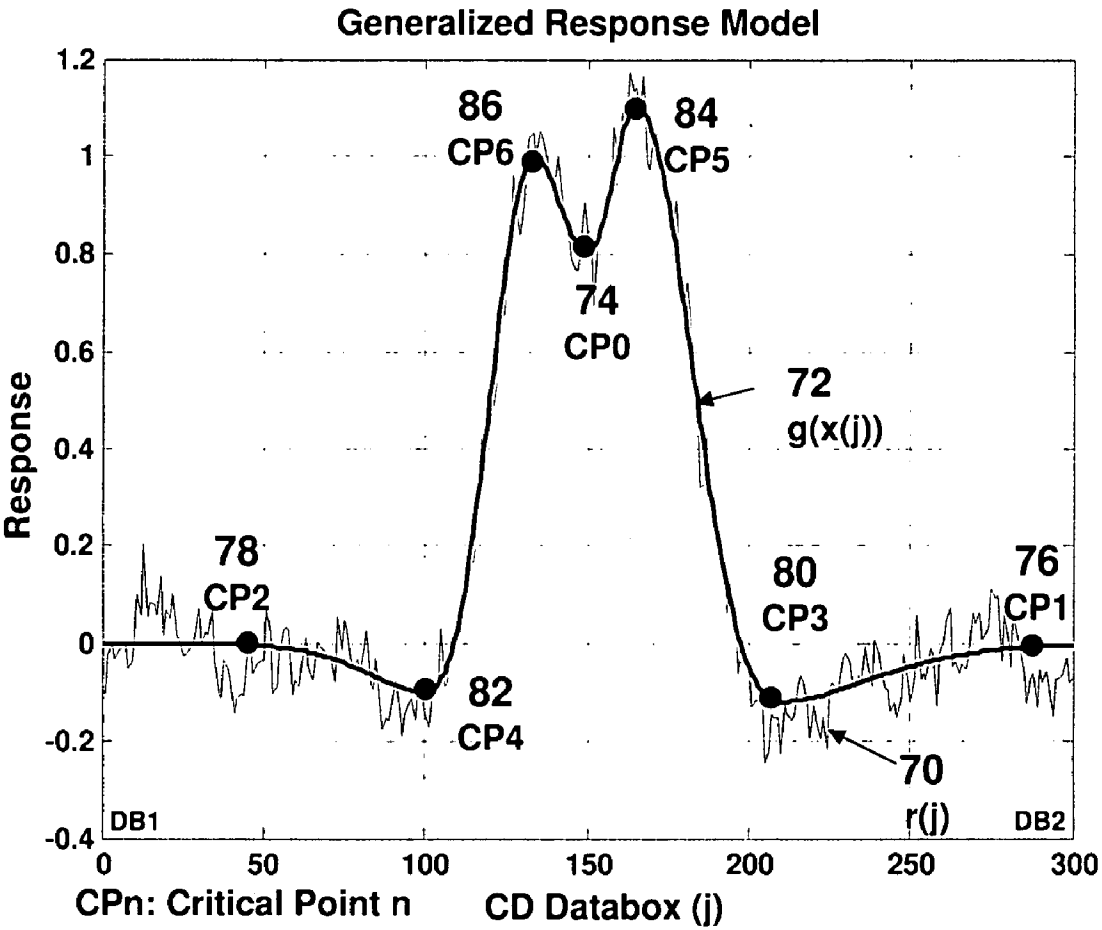
FIG. 3 shows a typical sheet property response profile and a generalized response model.

A measured response profile (such as the weight response profile 52 in FIG. 1) that is obtained from a machine usually includes both the true property response and some disturbances. An example of a measured property response is shown in FIG. 3 and is designated by the reference numeral 70. The measured response profile 70 obtained from a machine is usually expressed in an array of values r(j) where "j" is the index of each databox as shown in FIG. 3. The present invention uses the finite number of critical points (CP0 to CP6) and a finite set of continuous functions 72 to connect those critical points for modeling the true property response. As an example, the continuous functions are selected from a group of functions or their combinations that resemble a portion of the response profile such as Gaussian, sinusoidal, Mexican-hat wavelet, exponential, and/or polynomial functions. These functions are typically expressed as follows:

Gaussian Function:

$$h(x)=be^{-a(x-x_p)^2}\ x_p<x$$

Sinusoidal Functions:

$$h(x)=a+b\cos(c\pi(x-x_c)/(x_p-x_c))\ x_c<x<x_p$$

$$h(x)=a+b\sin(c\pi(x-x_c)/(x_p-x_c))\ x_c<x<x_p$$

Mexican-Hat Wavelet Function $$h(x)=[1-b(x-x_p)^2]e^{-a(x-x_p)^2}\ x_p<x$$

Exponential Function $$h(x)=a(1-e^{-(x-x_p)/b})\ x_p<x$$

Polynomial Function $$h(x)=c_0+c_1(x-x_p)+c_2(x-x_p)^2+c_3(x-x_p)^3+\ldots\ x_p<x$$

where "x" represents the continuous points along the CD or MD axis;

$x_p$, $x_c$ are locations of critical points;

a, b, c, $c_0$, $c_1$, $c_2$, $c_3$, . . . are constant coefficients for functions.

Based on the responses obtained from a wide range of CD actuators and various sheet properties, the actual property responses are classified into a finite number of response types. As discussed above, FIG. 2 illustrates five different response types that have been obtained from a wide range of paper machines. A response profile of a CD actuator zone is first classified into one of the predetermined response types using the critical points obtained in the manner described above. This classification step may be performed manually by a person viewing a display of the actual response profile on a screen of the UI devices of the computer system 28 and then manually selecting one of the predetermined response types. Alternately, the classification step may be automatically performed by the classification program stored in memory and executed by a processor of the computer system 28. Once a response type has been selected, the critical points and the continuous functions are modified to properly fit with the measured response profile. This fitting is automatically performed by a fitting program that is stored in memory and executed by a processor of the computer system 28. The fitting program minimizes a quadratic function of the deviations between the measured response r(j) and the generalized response model g(x(j)) at each databox j where "x" represents the continuous points along the CD axis of FIG. 3. The quadratic function Q of the deviations is illustrated in the following expression:

$$Q = \sum_{j=DB1}^{DB2} (r(j) - g(x(j)))^2 / (DB2 - DB1)$$

where DB1 and DB2 are the starting and ending databoxes of a response profile, respectively.

After the continuous functions have been fitted, the fitting program may optimize the critical points and the continuous functions by perturbing the critical points slightly and fitting the continuous functions accordingly until the minimal quadratic value is achieved.

Figure 4:
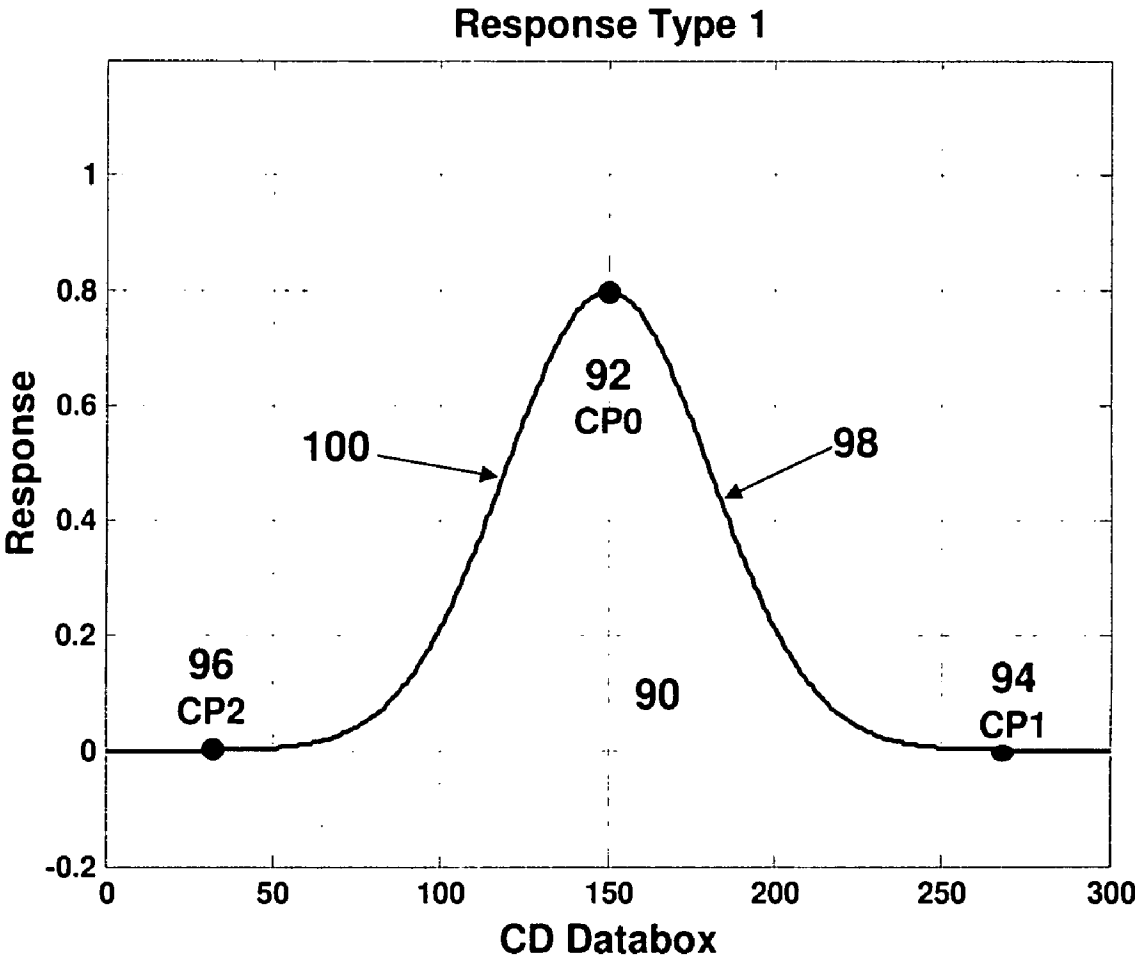
FIG. 4 shows a first type of a generalized response model.

While the present invention is generally applicable to a wide variety of response types, those most commonly encountered response types are described and illustrated herein. The application of the generalized response models for two of these response types (namely the first response type 60 and the fourth response type 66) is discussed in detail below. A first generalized response model 90 for a response of the first response type 60 is shown in FIG. 4. The first generalized response model 90 is the most common generalized response model. The impact of many CD actuators such as dilution profilers, water spray profilers, and induction profilers on sheet property profiles such as weight, moisture and caliper, respectively, can be modeled with the first generalized response model 90. As shown, the first generalized response model 90 has three critical points 92, 94, and 96 (i.e. CP0, CP1, and CP2) and two continuous functions 98 and 100; the first continuous function 98 connects the critical point CP0 and CP1 and the second continuous function 100 connects the critical points CP0 and CP2. At each critical point, two connected functions should have smooth connections, i.e. two connected functions should have the same slope at each connection point (i.e. critical point).

The center critical point CP0 is considered the center of the first generalized response model 90. The location of the center critical point CP0, $x_c$, and its magnitude $g_c$, the locations of the other two critical points CP1, $x_{rz}$, and CP2, $x_{lz}$, and the pre-selected continuous functions are the only information needed to create a first generalized response model 90. A first generalized response model 90 for a response of the first response type 60 is produced by connecting together the following two continuous functions:

$$g(x)=g_c e^{-a_{rp}(x-x_c)^2} \quad x_c<x<x_{rz}$$

$$g(x)=g_c e^{-a_{lp}(x-x_c)^2} \quad x_c>x>x_{lz}$$

where $x_c$ location of the center of the response CP0

$g_c$ response magnitude at the center CP0

$x_{rz}$ location of the right-side end point CP1

$a_{rp}$ parameter to adjust the right-side Gaussian function $x_{lz}$ location of the left-side end point CP2

$a_{lp}$ parameter to adjust the left-side Gaussian function

Figure 5:
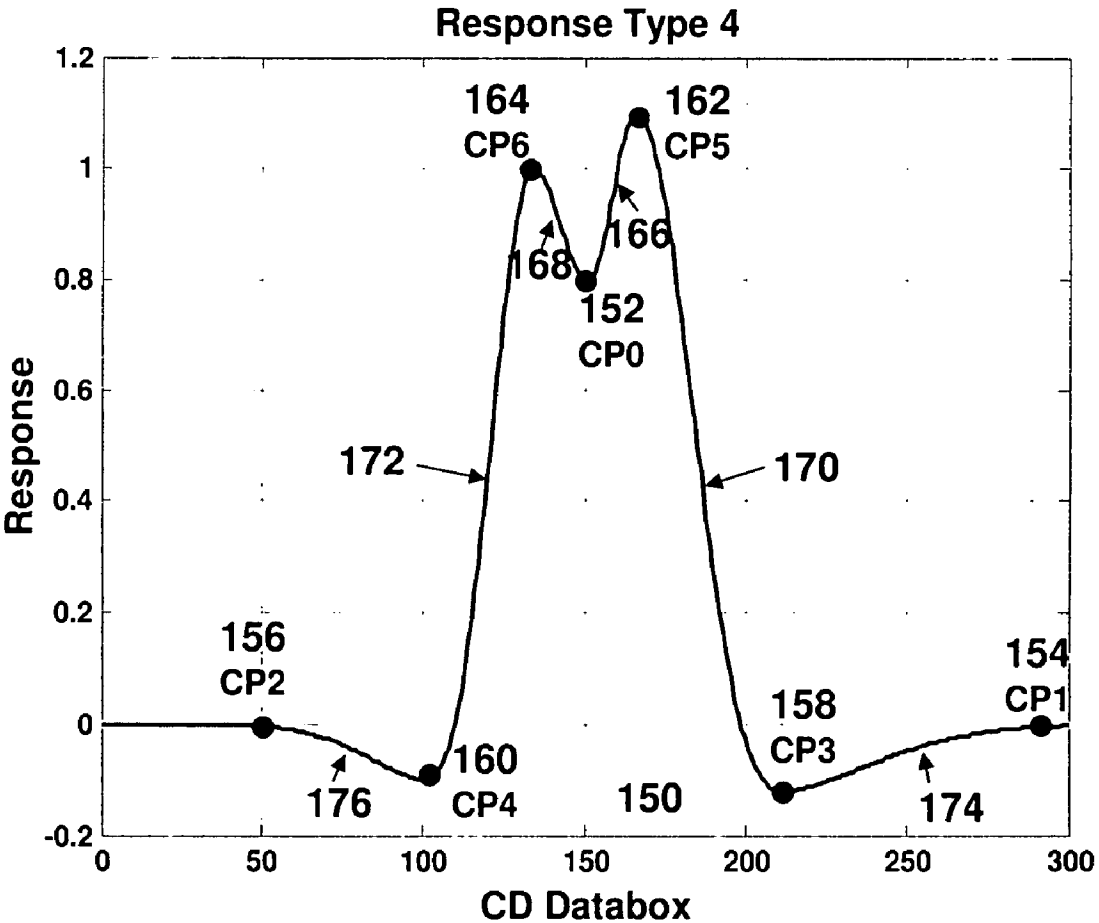
FIG. 5 shows a fourth type of a generalized response model.

A plot of a second generalized response model 150 for a response of the fourth response type 66 is shown in FIG. 5. This type of the generalized response model is commonly obtained from the movement of slice screw actuators for slower paper machines or machines producing heavier grades of paper such as linerboard or kraftpaper. As shown in FIG. 5, the second generalized response model 150 has seven critical points 152, 154, 156, 158, 160, 162, and 164 (i.e. CP0, CP1, CP2, CP3, CP4, CP5 and CP6), two sinusoidal functions 166, 168 and four Mexican-hat wavelet functions 170, 172, 174, and 176. The first Mexican-hat wavelet function 174 connects the critical point CP1 and CP3. The second Mexican-hat wavelet function 170 connects the critical points CP3 and CP5. The first sinusoidal function 166 connects the critical points CP5 and CP0. The second sinusoidal function 168 connects the critical points CP0 and CP6. The third Mexican-hat wavelet function 172 connects critical points CP6 and CP4 and the last Mexican hat wavelet function 176 connects the critical points CP4 and CP2. At each critical point, two connected functions should have smooth connections, i.e. two connected functions should have the same slope at each connection point (i.e. critical point).

The center critical point CP0 is considered the center of the second generalized response model 150. The location of the center critical point CP0, $x_c$, and its magnitude $g_c$, the locations of the other six critical points and their magnitudes, $x_{rp}$ and $g_{rp}$ of CP5 (peak), $x_{lp}$ and $g_{lp}$ of CP6 (peak), $x_{rn}$ and $g_{rn}$ of CP3 (trough), $x_{ln}$ and $g_{ln}$ of CP4 (trough), $x_{rz}$ of CP1 (end) and $x_{lz}$ of CP2 (end), the sinusoidal functions and the Mexican hat wavelet functions are the only information needed to create a second generalized response model 150. The peak gains, $g_{rp}$ and $g_{lp}$ must have the same sign as that of the center gain $g_c$. The trough gains, $g_{rn}$ and $g_{ln}$ must have the opposite sign as that of the center gain $g_c$. A second generalized response model 150 for the fourth response type 66 is produced by connecting together the following six continuous functions:

$$g(x)=g_{rp}[1-b_{rp}(x-x_{rp})^2]e^{-a_{rp}(x-x_{rp})^2} \quad x_{rp}<x<x_{rn}$$

$$g(x)=g_p[1-b_{rn}(x-x_{rn})^2]e^{-a_{rn}(x-x_{rn})^2} \quad x_{rn}<x<x_{rz}$$

$$g(x)=(g_{rp}+g_c)/2-[(g_{rp}-g_c)/2]\cos(\pi(x-x_c)/(x_{rp}-x_c)) \quad x_c<x<x_{rp}$$

$$g(x)=(g_{lp}+g_c)/2-[(g_{lp}-g_c)/2]\cos(\pi(x-x_c)/(x_{lp}-x_c)) \quad x_c>x>x_{lp}$$

$$g(x)=g_{lp}[1-b_{lp}(x-x_{lp})^2]e^{-a_{lp}(x-x_{lp})^2} \quad x_{lp}>x>x_{ln}$$

$$g(x)=g_p[1-b_{ln}(x-x_{ln})^2]e^{-a_{ln}(x-x_{ln})^2} \quad x_{ln}>x>x_{lz}$$

where $x_c$ location of the center critical point CP0 (center of the response)

$g_c$ magnitude of the center critical point CP0

$x_{rp}$ location of the right-side peak CP5

$g_{rp}$ magnitude of the right-side peak CP5

$x_{lp}$ location of the left-side peak CP6

$g_{lp}$ magnitude of the left-side peak CP6

$x_{rn}$ location of the right-side trough CP3

$g_{rn}$ magnitude of the right-side trough CP3

$x_{ln}$ location of the left-side trough CP4

$g_{ln}$ magnitude of the left-side trough CP4

$x_{rz}$ location of the right-side end point CP1

$a_{rp}$,$b_{rp}$ parameters to adjust the right-side response (from CP5 to CP3)

$a_{rn}$,$b_{rn}$ parameters to adjust the right-side response (from CP3 to CP1)

$x_{lz}$ location of the left-side end point CP2

$a_{lp}$,$b_{lp}$ parameters to adjust the left-side response (from CP6 to CP4)

$a_{ln}$,$b_{ln}$ parameters to adjust the left-side response (from CP4 to CP2)

The creation of generalized response models, such as described above, is not limited to the example response types. The same modeling methodology can be extended to other response types with the properly defined critical points and properly selected continuous functions. As indicated in the previous five response types, there are no more than seven critical points needed to fully define a comprehensive response curve. In practice, no more than twenty critical points would be sufficient for the majority of applications.

Figure 6:
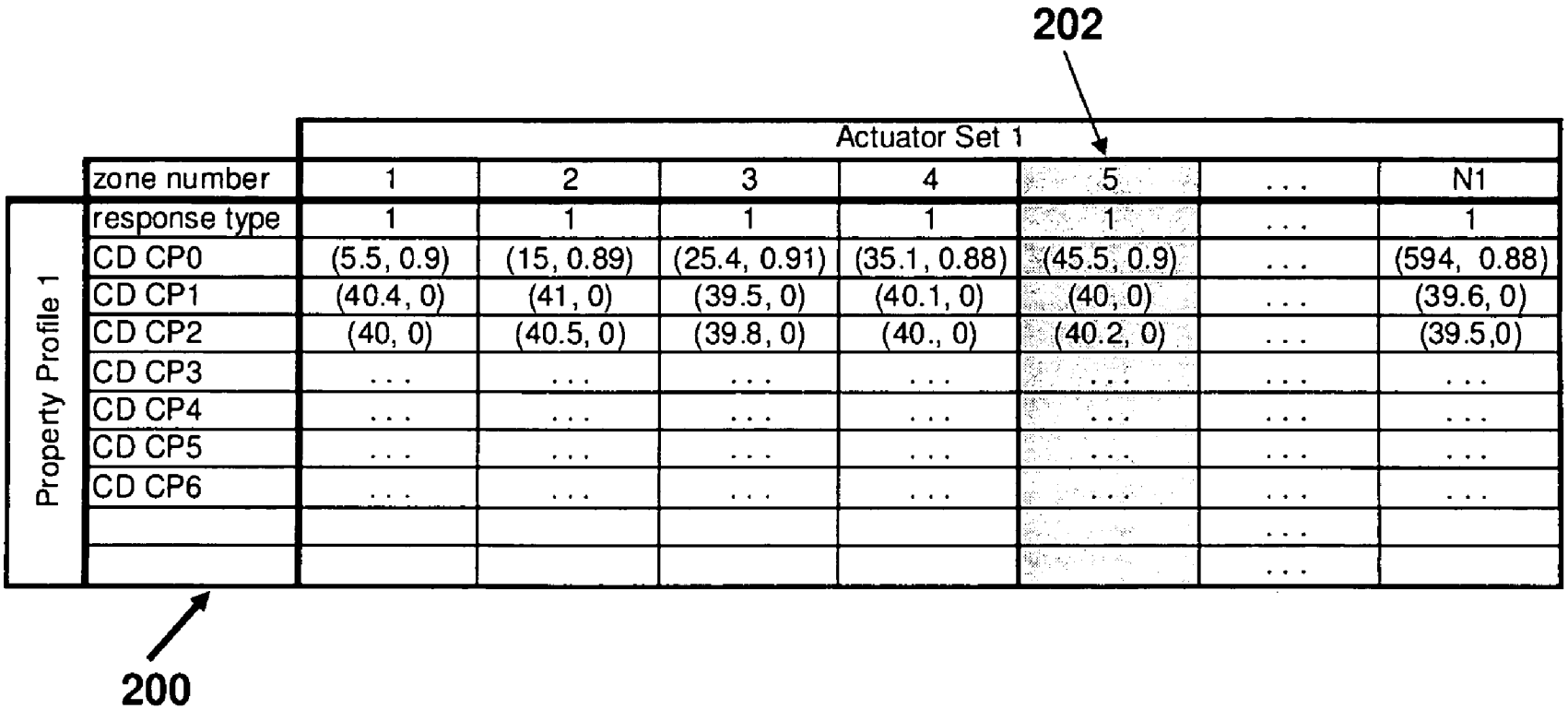
FIG. 6 shows a table of critical points of one set of actuators with respect to one sheet property profile.
Figure 8:
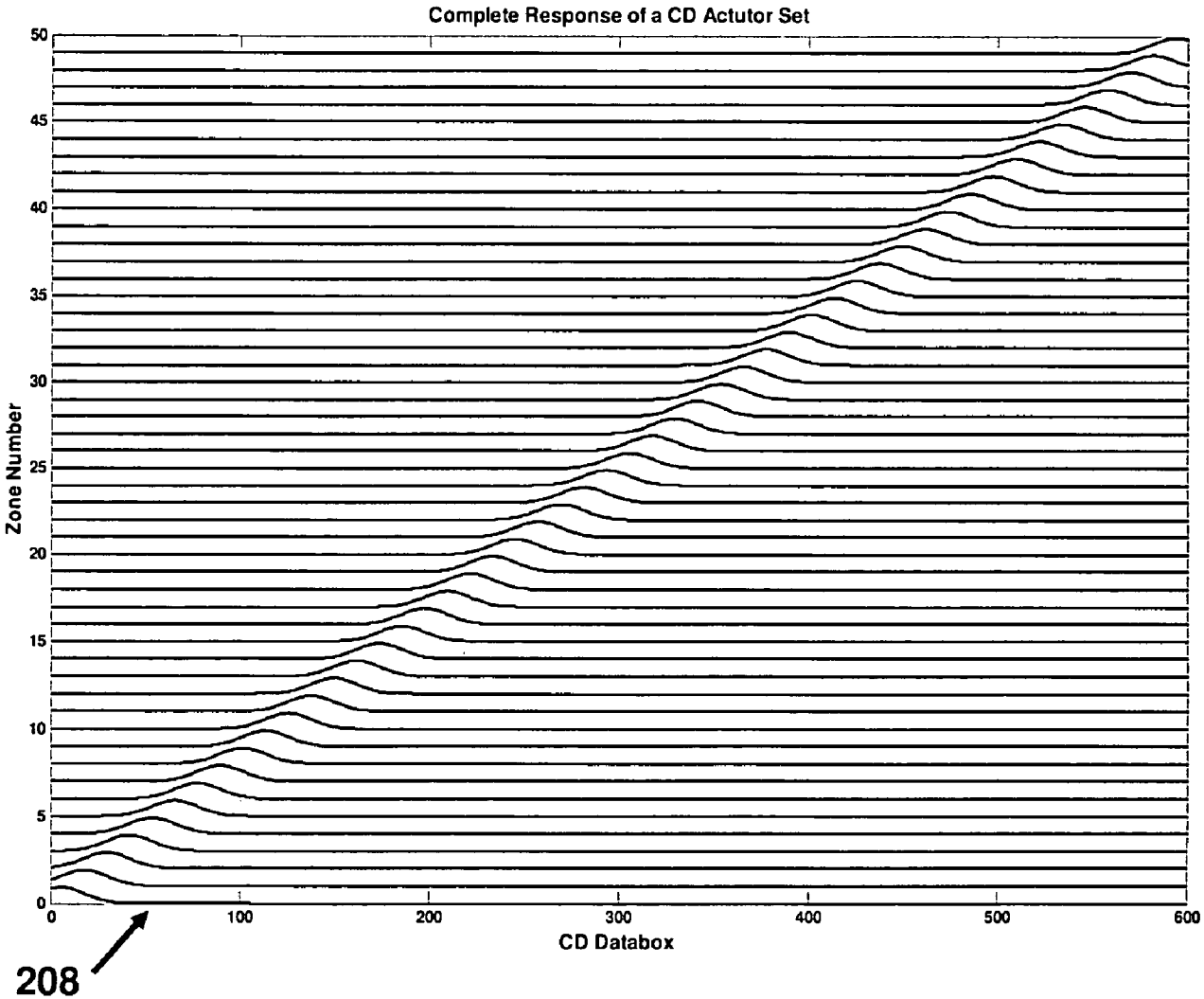
FIG. 8 shows a comprehensive response model of one set of actuators with respect to one sheet property profile.

The generalized response models of all actuator zones are further used to create a comprehensive response model based on the response type, the critical points and the continuous functions of each actuator zone. Referring to FIG. 6, an example of a comprehensive response model between one set of CD actuators and one sheet property profile is expressed in table 200. In table 200, each column represents the generalized response model for one actuator zone. Each column (such as column 202) comprises response type and critical points. The present invention uses the information specified in the columns of table 200 to create continuous response profiles that span the entire sheet width. FIG. 7 shows an example of the continuous response profile 204 for actuator zone 5 from table 200. Depending on the resolution a user decides to use (which is typically the same as the resolution of a measured profile or the actuator resolution) the continuous response profile 204 is discretized in an array of points as indicated by the circles 206 which overlay the continuous response profile in FIG. 7. Each array of points from the discretized response profile forms a column in a matrix that represents a multi-zone response model between the whole set of CD actuator zones and the full-width property profile. The comprehensive response model is created by building the response matrix with multiple actuator zones from a set of CD actuator zones. FIG. 8 illustrates a plot of the comprehensive response model 208 of the example that is specified by the table 200 in FIG. 6. Each line in FIG. 8 is a response profile created from one column of the table in FIG. 6 with the present invention. The matrix of the multi-zone response model 208 can be used for closed-loop control, control performance monitoring, process response prediction from actuator setpoint changes and many other applications.

The present technique can be further extended to create a comprehensive response model for a multivariable process where there are multiple sets of CD actuators to control multiple sheet property profiles. The table 210 in FIG. 9 illustrates an example of a multivariable process where two sets of CD actuators are used to control two sheet property profiles. This table can be easily extended to other sizes of multivariable process.

Figure 11:
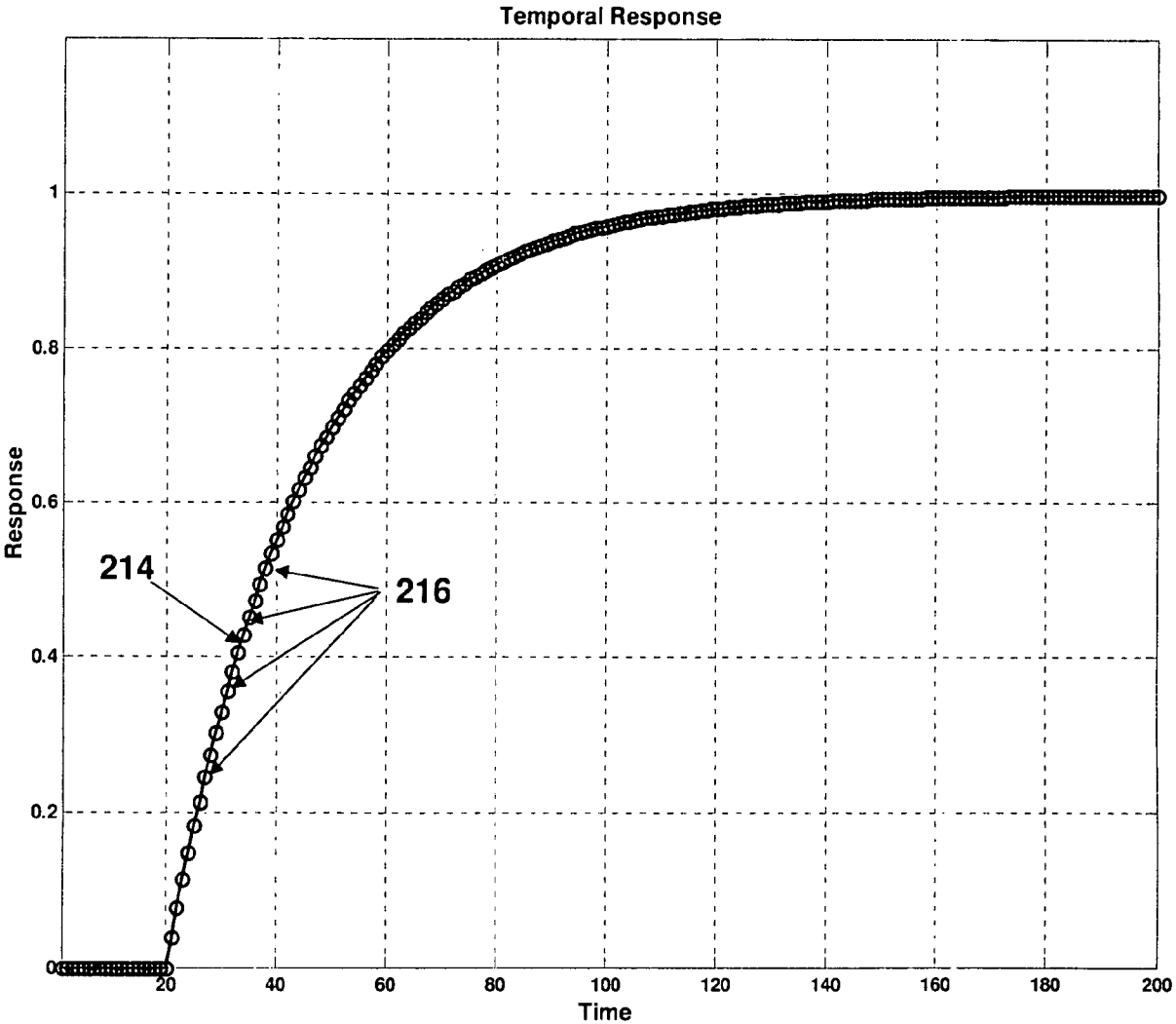
FIG. 11 shows a temporal response of an actuator zone.

The present technique can also be extended to specify the MD response function. Referring to FIG. 10, an example of the first order response with dead-time delay is specified by the table 212 in FIG. 10. Table 212 is extended from table 200 in FIG. 6 by adding two additional critical points in machine direction for specifying the temporal response. Similar to the example for CD response profile illustrated in FIG. 7, the temporal response of an actuator zone is illustrated in FIG. 11 where the continuous response function is 214 and the discretized response curve is 216. Similarly, this discretized response curve is used to build the comprehensive response model for temporal response.

The present invention provides a number of benefits. A comprehensive response model can be created from a plurality of continuous response models using a resolution that is appropriate to an application. In this manner, the need to store, handle and manipulate an unnecessarily large amount of data can be avoided.

As will be appreciated by one of skill in the art and as before mentioned, the present invention may be embodied as or take the form of the method previously described, a computing device or system having program code configured to carry out the operations, a computer program product on a computer-usable or computer-readable medium having computer-usable program code embodied in the medium. The computer-usable or computer-readable medium may be any medium that can contain, store, communicate, propagate, or transport the program for use by or in connection with the instruction execution system, apparatus, or device and may by way of example but without limitation, be an electronic, magnetic, optical, electromagnetic, infrared, or semiconductor system, apparatus, device, or propagation medium or even be paper or other suitable medium upon which the program is printed. More specific examples (a non-exhaustive list) of the computer-readable medium would include: a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission media such as those supporting the Internet or an intranet, or a magnetic storage device. Computer program code or instructions for carrying out operations of the present invention may be written in any suitable programming language provided it allows achieving the previously described technical results. The program code may execute entirely on the user's computing device, partly on the user's computing device, as a stand-alone software package, partly on the user's computer and partly on a remote computer or entirely on a remote computer or server or a virtual machine. In the latter scenario, the remote computer may be connected to the user's computer through a local area network (LAN) or a wide area network (WAN), or the connection may be made to an external computer (for example, through the Internet using an Internet Service Provider).

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. A method of creating a comprehensive response model for a plurality of actuator zones of a sheet-forming machine, the actuator zones being operable to control properties of a sheet, the method being performed by a computer system and comprising:

providing a continuous response model for each of the actuator zones of the sheet-forming machine based on measured property profiles of the sheet received from one or more sensors of the sheet-forming machine, the continuous response models each comprising a plurality of continuous functions;

for each of the continuous response models, discretizing the continuous functions to obtain an array of points; and building the comprehensive response model from the points obtained from discretizing the continuous functions of the continuous response models, the comprehensive response model being a data matrix for controlling, monitoring and/or simulating the operation of the sheet-forming machine.

2. The method of claim 1, wherein the comprehensive response model is for a plurality of actuator sets operable to control a plurality of sheet properties, and wherein the method comprises providing a continuous response model for each actuator zone in each set, discretizing the continuous functions of each continuous response model in each set and building the comprehensive response model using the points from the discretized functions of the continuous response models of a plurality of the sets.

3. The method of claim 1, wherein the step of providing the continuous response model for each of the actuator zones comprises, for each of the actuator zones:

specifying a response type according to a response profile of the at lest one actuator zone;

specifying a set of critical points associated with the response type; and in each of a plurality of pairs of adjacent critical points, connecting the adjacent critical points with one of the continuous functions.

4. The method of claim 3, wherein the step of specifying the response type comprises selecting the response type from a plurality of predetermined response types.

5. The method of claim 3, wherein the step of specifying the critical points comprises specifying a finite number of cartesian coordinates, each of which has an x-coordinate that is a location in either machine direction or cross-machine direction and a y-coordinate that is a gain of the response of the critical point.

6. The method of claim 3, wherein one or more of the critical points are selected from the group consisting of local maximums, local minimums, inflection points, corner points and combinations of the foregoing.

7. The method of claim 3, wherein the continuous functions are determined based on the specified response type.

8. The method of claim 1, wherein the continuous functions are selected from the group consisting of Gaussian functions, sinusoidal functions, Mexican hat wavelet functions, exponential functions, polynomial functions and combinations of the foregoing.

9. The method of claim 1, wherein the continuous functions connect adjacent critical points and wherein the continuous functions are continuous at each critical point.

10. The method of claim 1, where the step of discretizing the continuous functions includes for each continuous function, calculating the value of the continuous functions with respect to a center location of each databox for a plurality of databoxes.

11. The method of claim 1, wherein the property of the sheet is selected from the group consisting of moisture content, sheet weight, fiber orientation and sheet thickness.

12. A computer system comprising a processor and non-transitory computer storage medium having instructions stored thereon, which when executed by the processor perform a method of creating a comprehensive response model for a plurality of actuator zones of a sheet-forming machine, the actuator zones being operable to control properties of a sheet, the method comprising:

providing a continuous response model for each of the actuator zones of the sheet-forming machine based on measured property profiles of the sheet received from one or more sensors of the sheet-forming machine, the continuous response models each comprising a plurality of continuous functions;

for each of the continuous response models, discretizing the continuous functions to obtain an array of points; and building the comprehensive response model from the points obtained from discretizing the continuous functions of the continuous response models, the comprehensive response model being a data matrix for controlling, monitoring and/or simulating the operation of the sheet-forming machine.

13. The computer of claim 12, wherein the comprehensive response model is for a plurality of actuator sets operable to control a plurality of sheet properties, and wherein the method comprises providing a continuous response model for each actuator zone in each set, discretizing the continuous functions of each continuous response model in each set and building the comprehensive response model using the points from the discretized functions of the continuous response models of a plurality of the sets.

14. The computer system of claim 12, wherein the step of providing the continuous response model for each of the actuator zones comprises, for each of the actuator zones:

specifying a response type according to a response profile of the at lest one actuator zone;

specifying a set of critical points associated with the response type; and in each of a plurality of pairs of adjacent critical points, connecting the adjacent critical points with one of the continuous functions.

15. The computer system of claim 14, wherein the step of specifying the response type comprises selecting the response type from a plurality of predetermined response types.

16. The computer system of claim 14, wherein the step of specifying the critical points comprises specifying a finite number of cartesian coordinates, each of which has an x-coordinate that is a location in either machine direction or cross-machine direction and a y-coordinate that is a gain of the response of the critical point.

17. The computer system of claim 14, wherein one or more of the critical points are selected from the group consisting of local maximums, local minimums, inflection points, corner points and combinations of the foregoing.

18. The computer system of claim 14, wherein the continuous functions are determined based on the specified response type.

19. The computer system of claim 12, wherein the continuous functions are selected from the group consisting of Gaussian functions, sinusoidal functions, Mexican hat wavelet functions, exponential functions, polynomial functions and combinations of the foregoing.

20. The computer system of claim 12, wherein the continuous functions connect adjacent critical points and wherein the continuous functions are continuous at each critical point.

21. The computer system of claim 12, where the step of discretizing the continuous functions includes for each continuous function, calculating the value of the continuous functions with respect to a center location of each databox for a plurality of databoxes.

22. The computer system of claim 12, wherein the property of the sheet is selected from the group consisting of moisture content, sheet weight, fiber orientation and sheet thickness.

* * * * *